United States Patent [19]

McDanald

[11] 4,141,841

[45] Feb. 27, 1979

[54] ANTISTATIC, FABRIC-SOFTENING DETERGENT ADDITIVE

[75] Inventor: Stephen R. McDanald, Cincinnati, Ohio

[73] Assignee: The Procter & Gamble Company, Cincinnati, Ohio

[21] Appl. No.: 816,761

[22] Filed: Jul. 18, 1977

[51] Int. Cl.[2] ..... D06M 13/46

[52] U.S. Cl. ..... 252/8.8; 252/8.9; 264/117

[58] Field of Search ..... 252/8.8, 8.9; 264/117

[56] References Cited

U.S. PATENT DOCUMENTS

| | | | |
|---|---|---|---|
| 3,664,961 | 5/1972 | Norris | 264/117 |
| 3,936,537 | 2/1976 | Baskerville et al. | 252/8.8 |
| 3,950,275 | 4/1976 | Toyoda et al. | 264/117 |
| 3,966,629 | 6/1976 | Dumbrell | 252/8.8 |

OTHER PUBLICATIONS

Rose–The Cond. Chem. Dict. 7th Ed. 1966 Reinhold Publ. Co. p. 287.

Industrial Gums–1973 Academic Press pp. 585–587, 593–594.

*Primary Examiner*—William E. Schulz

*Attorney, Agent, or Firm*—Robert B. Aylor; Thomas H. O'Flaherty; Richard C. Witte

[57] ABSTRACT

Detergent-compatible antistatic compositions contain a combination of cationic antistatic agents, organic adjuncts, and water-soluble, alkaline salts as discrete particles. Preferred compositions also contain certain types of smectite clay to enhance fabric-softening properties.

38 Claims, No Drawings

ANTISTATIC, FABRIC-SOFTENING DETERGENT ADDITIVE

BACKGROUND OF THE INVENTION

This invention relates to compositions which provide antistatic effects in fabric laundering operations. More particularly, it relates to providing these antistatic effects while simultaneously cleansing fabrics by means of conventional detergent compositions and detergency builders.

Various quaternary ammonium compounds are known in the art to possess antistatic properties. These quaternary ammonium compounds are known to be incompatible with anionic surfactants commonly employed in laundering compositions. Anionic surfactants attack and inactivate the quaternary ammonium compounds in solution (by forming insoluble salts). It therefore becomes a problem of shielding the quaternary ammonium compounds in the wash water environment, without disturbing their effectiveness at antistatic fabric softening in the subsequent drying process.

Quaternary ammonium compounds are fairly expensive. It has been necessary to add larger amounts of quaternary ammonium compounds to detergents than desired in order to avoid total inactivation in wash solution. Encapsulation of the quaternary ammonium compounds, while preventing inactivation in wash solution, often interferes with the antistatic, fabric-softening effectiveness of the quaternary ammonium compounds in subsequent machine drying. The quaternary ammonium antistatic agents also have a tendency to segregate out in a granular detergent admix because of disparities in particle size.

It is an object of the present invention to provide a particulate additive to laundry detergent compositions to reduce the tendency of fabrics washed with such detergent compositions to generate or retain static electricity when subjected to a subsequent machine drying process.

It is also an object of the present invention to provide detergent compositions incorporating discrete particulates which contain antistat materials capable of reducing the buildup of static charge on fabrics washed with such detergent compositions and subsequently subjected to machine drying.

It is another object of the present invention to provide a detergent composition capable of concurrently laundering, softening, and imparting antistatic benefits to fabrics washed therewith and subsequently machine dried.

It is a further object of the present invention to provide compositions containing certain clay fabric-softening agents and quaternary ammonium antistatic agents which are adapted for use in the washing cycle of a laundering operation.

It is a still further object of the present invention to provide a particulate antistatic fabric-softening composition which can be included in a conventional detergent composition and will retain its effectiveness in softening fabrics laundered therewith in a subsequent machine drying process.

It is yet a further object of the present invention to provide for maximum antistatic fabric-softening effectiveness by using a minimum amount of antistatic fabric-softening agent in a detergent composition.

It is even a further object of the present invention to provide for a strong, free-flowing, quaternary ammonium antistatic agent to be incorporated into detergent compositions, which can impart effective antistatic, fabric-softening benefits to fabrics laundered therewith in subsequent machine-drying.

It is still another object of the present invention to provide an antistatic, fabric-softening detergent additive which can be directly added to a granular detergent composition.

It is yet an even further object of the present invention to provide an antistatic, fabric-softening detergent additive which will remain homogeneously admixed in a conventional detergent composition.

BRIEF SUMMARY OF THE INVENTION

The present invention encompasses a particulate detergent additive for preventing static buildup on textiles and softening fabrics when applied thereto from a detergent wash liquor, said particulate product being an agglomerate of:

(a) from about 5% to about 75% by weight of a watersoluble, neutral or alkaline salt, and (b) from about 5% to about 75% by weight of particles being an intimate mixture of (i) from about 80% to about 20% by weight of the particles of a quaternary ammonium compound of the formula $[R_1R_2R_3R_4N]^+Y^-$ wherein at least one but not more than two of $R_1$, $R_2$, $R_3$ and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulfate, methylsulfate, ethylsulfate, and phosphate ions, and (ii) from about 20% to about 80% by weight of a dispersion inhibitor, being a solid organic material having a solubility in water of 50 ppm maximum at 25° C. and a softening point in the range of 100° F. to 200° F., said material being selected from the group consisting of paraffinic waxes, cyclic and acyclic mono-and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, and (c) from about 5% to about 75% by weight of an organic agglomerating agent, substantially all of the individual particles (b) having a size of about 10μ to about 500μ, and a solubility in water of about 50 ppm maximum at 25° C. and having a softening point of about 100° F. to about 200° F.

The present invention also encompasses a detergent composition for preventing static buildup on textiles and softening fabrics laundered therewith comprising:

(1) from about 5% to about 85% by weight of surfactant selected from the group consisting of anionic, nonionic, zwitterionic surfactants, and mixtures thereof, (2) from about 5% to about 85% by weight of detergency builder, and (3) from about 10% to about 50% by weight of a particulate detergent additive comprising an agglomerate of:

(a) from about 5% to about 75% by weight of a water-soluble, neutral or alkaline salt, and (b) from about 5% to about 75% of particles being an intimate mixture of (i) from about 80% to about 20% by weight of the particles of a quaternary ammonium compound of formula $[R_1R_2R_3R_4N]^+Y^-$ wherein at least one but not more than two of $R_1$, $R_2$, $R_3$ and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide halide, sulfate and methylsulfate, ethylsulfate and phosphate ions, and (ii) from about 20% to about 80% by weight of a dispersion inhibitor, being a solid organic material having a solubility in water of 50 ppm maximum at 25° C. and a softening point in the range of 100° F. to 200° F., said material being selected from the group consisting of paraffinic waxes, cyclic and acyclic mono- and polyhydric alcohols, substituted and unsubstituted aliphatic carboxylic acids, esters of the foregoing alcohol and acids, $C_3$–$C_4$ alkylene oxide condensates of any of the foregoing materials and mixtures thereof, and (c) from about 5% to about 75% by weight of an organic agglomerating agent, substantially all of the individual particles (b) of the particulate detergent additive having a size of about 10μ to about 500μ, and a solubility in water of about 50 ppm maximum at 25° C. and having a softening point of about 100° F. to about 200° F.

DETAILED DESCRIPTION OF THE INVENTION

The additive product and method of this invention comprise three essential ingredients: the water-soluble neutral or alkaline salt; the quaternary ammonium antistatic agent; the solid organic dispersion inhibitor. The additive product can additionally comprise a smectite clay, while the overall detergent composition of this invention can additionally comprise a water-soluble detergency compound and a detergency builder salt. The quaternary ammonium compound provides antistatic benefits on the fabrics and also adds an increment of softening benefit to the fabrics, while the detergent surfactant and builder components provide known cleansing and building benefits.

The individual particle size of the particulate detergent additive lies in the range from about 10μ (microns) to 500μ (microns), preferably from about 25μ (microns) to about 250μ (microns), and most preferably from about 50μ (microns) to about 100μ (microns). Further, the particulate additive should not have a solubility in water at 25° C. of greater than 50 ppm (parts per million), preferably less than 10 ppm (parts per million). The softening or melting point of the particulate additive should lie in the range from about 100° to about 200° F., preferably from about 150° F. to about 175° F.

WATER-SOLUBLE, NEUTRAL OR ALKALINE SALT

The first essential component of the detergent additive composition is a water-soluble, neutral or alkaline salt. A neutral or alkaline salt has a pH in solution of seven or greater. This salt may be either organic or inorganic. The water-soluble, neutral or alkaline salt will be employed in the particulate detergent additive in an amount from about 5% to about 75% by weight, preferably from about 5% to about 40% by weight, more preferably from about 10% to about 30% by weight, most preferably from about 10% to about 20% by weight. Specifically, some of the water-soluble, neutral or alkaline salts will absorb moisture during the processing of the particulate detergent additive, and in addition function as detergency builders in wash water solutions. Although the exact mechanism is not known, inclusion of water-soluble, neutral alkaline salt within an agglomerate, comelt, prill, or other discrete combination of quaternary ammonium antistatic compound and organic dispersion inhibitor results in increased antistatic, fabric-softening performance of the resulting combination with lesser amounts of quaternary ammonium antistatic compound.

Examples of such water-soluble neutral or alkaline salts include alkali metal chlorides such as sodium chloride and potassium chloride, alkali metal fluorides such as sodium fluoride and potassium fluoride, alkali metal carbonates such as sodium carbonates, alkali metal silicates, and mixtures thereof. Any conventional water-soluble, neutral or alkaline inorganic salts such as the alkali metal sulfates, notably sodium sulfate, may be employed in the present invention.

Water-soluble, neutral or alkaline salts also include the variety commonly known as detergency builder salts, especially alkaline, polyvalent anionic builder salts. Suitable detergency builder salts include polyvalent inorganic or organic salts or mixtures thereof. Suitable water-soluble, preferred inorganic alkaline detergency builder salts include alkali metal carbonates, borates, phosphates, polyphosphates, bicarbonates, silicates, and sulfates. Specific examples of such salts include the sodium and potassium tetraborates, perborates, bicarbonates, carbonates, tripolyphosphates, pyrophosphates, orthophosphates and hexametaphosphates.

Examples of suitable organic alkaline detergency builder salts are: water-soluble aminopolyacetates, e.g., sodium and potassium ethylenediaminetetraacetates, nitrilotriacetates and N-(2-hydroxyethyl)nitrilodiacetates; water-soluble salts of phytic acid, e.g., sodium and potassium phytates; water-soluble polyphosphonates, including sodium, potassium and lithium salts of ethane-1-hydroxy-1,1-diphosphonic acid; sodium, potassium and lithium salts of methylene diphosphonic acid and comparable examples.

Additional organic builder salts are disclosed in Ser. No. 764,126, Rodney M. Wise, et al, filed Jan. 31, 1977, entitled "Process for making Detergent Compositions", incorporated herein by reference, in U.S. Pat. No. 3,308,067, to F. L. Diehl, filed Apr. 1, 1963, incorporated herein by reference, and in U.S. Pat. No. 2,264,103, to N. B. Tucker, filed June 6, 1936, incorporated herein by reference. The Tucker patent particularly discloses polycarboxylate and citrate salts, notably sodium citrate which may be used in the present invention as a water-soluble, alkaline salt. Further detergency builder salts are disclosed in U.S. Pat. No. 3,936,537, to Baskerville, Jr. et al, filed Nov. 1, 1974, incorporated herein by reference.

Intimate Mixture of Quaternary Ammonium Antistatic Agent and Organic Dispersion Inhibitor The second essential ingredient of the agglomerates of the present invention is the intimate mixture of quaternary ammonium antistatic agent and organic dispersion inhibitor. This intimate mixture of quaternary ammonium antistatic agent and organic dispersion inhibitor will be employed in the particulate detergent additive in an amount from about 5% to about 75% by weight, preferably from about 10% to about 60% by weight, and most preferably from about 30% to about 50% by weight.

Quaternary Ammonium Antistatic Agent

Suitable quaternary ammonium antistatic agents are included in U.S. Pat. No. 3,936,537, the Baskerville patent, which has been incorporated hereinabove by reference. The quaternary ammonium antistatic agents will normally be employed at a level of from about 80% to about 20% by weight, preferably from about 80% to about 60% by weight, and most preferably from about 80% to about 70% by weight of the intimate mixture of quaternary ammonium compound and organic dispersion inhibitor.

The antistatic agents useful herein are quaternary ammonium salts of the formula $[R_1R_2R_3R_4N]^+Y^-$ wherein $R_1$ and preferably $R_2$ represent an organic radical containing a group selected from a $C_{16}$–$C_{22}$ aliphatic radical or an alkyl phenyl or alkyl benzyl radical having 10–16 atoms in the alkyl chain, $R_3$ and $R_4$ represent hydrocarbyl groups containing from 1 to about 4 carbon atoms, or $C_2$–$C_4$ hydroxy alkyl groups and cyclic structures in which the nitrogen atom forms part of the ring, and Y is an anion such as halide methylsulfate, or ethylsulfate.

In the context of the above definition, the hydrophobic moiety (i.e., the $C_{16}$–$C_{22}$ aliphatic, $C_{10}$–$C_{16}$ alkyl phenyl or alkyl benzyl radical) in the organic radical $R_1$ may be directly attached to the quaternary nitrogen atom or may be indirectly attached thereto through an amide, ester, alkoxy, ether, or like grouping.

The quaternary ammonium antistatic compounds useful herein include both water-soluble and substantially water-insoluble materials. Imidazolinium compounds enumerated in the Baskerville patent possess appreciable water solubility and can be utilized in the present invention by mixing with the appropriate type and level of organic dispersion inhibitor to give ultimate particle solubility in water of less than 50 ppm (parts per million) at 25° C. Relatively water-soluble quaternary ammonium antistatic agents can be used, such as diisostearyl dimethyl ammonium chlorides disclosed in U.S. Pat. No. 3,395,100 to Fisher et al, incorporated herein by reference. Exemplary quaternary ammonium imidazolinium compounds are specifically methyl, 1-alkylamidoethyl, 2-alkyl imidazolinium methyl sulfates, specifically 1-methyl-1-[(tallowamido)ethyl]-2-tallowimidazolinium methyl sulfate. However, the most useful quaternary ammonium antistatic agents are characterized by relatively limited solubility in water.

The quaternary ammonium antistatic agents used in this invention can be prepared in various ways well known in the art. Many such materials are commercially available. The quaternaries are often made from alkyl halide mixtures corresponding to the mixed alkyl chain lengths in fatty acids. For example, the "ditallow" quaternaries are made from alkyl halides having mixed $C_{14}$–$C_{18}$ chain lengths. Such mixed di-long chain quaternaries are useful herein and are preferred from a cost standpoint.

The following are representative examples of substantially water-insoluble quaternary ammonium antistatic agents suitable for use in the compositions and processes of the instant invention. All of the quaternary ammonium compounds listed can be formulated with the detergent compositions herein, but the compilation of suitable quaternary compounds hereinafter is only by way of example and is not intended to be limiting of such compounds. Dioctadecyldimethylammonium chloride is an especially preferred quaternary antistatic agent for use herein by virtue of its high antistatic activity; ditallowdimethyl ammonium chloride is equally preferred because of its ready availability and its good antistatic activity; other useful di-long chain quaternary compounds are dicetyldimethyl ammonium chloride; bis-docosyldimethyl ammonium chloride; didodecyldimethyl ammonium chloride; ditallowdimethyl ammonium bromide; dioleoyldimethyl ammonium hydroxide; ditallowdimethyl ammonium chloride, ditallowdipropyl ammonium bromide; ditallowdibutyl ammonium fluoride, cetyldecylmethylethyl ammonium chloride, bis-[ditallowdimethyl ammonium]sulfate; tris-[ditallowdimethyl ammonium]phosphate; and the like.

The preceding description of quaternary ammonium antistatic compounds is an abbreviated discussion. Description in further detail is contained in U.S. Pat. No. 3,936,537, incorporated hereinabove by reference.

ORGANIC DISPERSION INHIBITOR

The organic dispersion inhibitor comprises from about 20% to about 80% by weight, preferably from about 20% to about 40% by weight, and most preferably 20% to about 30% by weight of the intimate mixture of quaternary ammonium compound and organic dispersion inhibitor. The dispersion inhibitor should have a solubility in water of 50 ppm maximum at 25° C. and a softening point in the range of 100°–200° F., preferably 125°–200° F., and is preferably selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof.

Tallow alcohol is preferred because of ready availability, but useful dispersion inhibitors include other fatty alcohols in the $C_{14}$–$C_{26}$ range such as myristyl alcohol, cetyl alcohol, stearyl alcohol, arachidyl alcohol, behenyl alcohol, and mixtures thereof. Saturated fatty acids having 12 to 24 carbon atoms in the alkyl chain can be used such as: lauric acid, myristic acid, palmitic acid, stearic acid, arachidic acid, and behenic acid, as well as mixtures of these, particularly those derived from naturally occurring sources such as tallow, coconut, and marine oils. Esters of the aliphatic alcohols and fatty acids are useful dispersion inhibitors, provided they have a total of more than 22 carbon atoms in the acid and alkyl radicals. Long chain $C_{22}$–$C_{30}$ paraffinic hydrocarbon materials such as the saturated hydrocarbon octacosane having 28 carbon atoms can also be used.

Another preferred class of materials useful in the present invention are the water-insoluble sorbitan esters which comprise the reaction product of $C_{12}$–$C_{26}$ fatty acyl halides or fatty acids and the complex mixtures of cyclic anhydrides of sorbitol collectively known as "sorbitan". The reaction sequence necessary to produce such sorbitan esters from sorbitol is set out in the Baskerville patent incorporated by reference. The sorbitan esters are, in turn, complex mixtures of mono-, di-, tri-, and tetra- ester forms, of which the tri- and tetra- are the least water-soluble and hence the most preferred for the purposes of the present invention. Typical fatty acids that are suitable for the alkyl portion of the ester are palmitic, stearic, docosanoic, and behenic acids and mixtures of any of these. These sorbitan esters, particularly the tri and tetra esters, provide a degree of fabric softening in addition to their function as dispersion inhibitors.

The previous discussion of organic dispersion inhibitors is an abbreviated one. Further discussion in detail is set out in U.S. Pat. No. 3,936,537, incorporated herein by reference.

ORGANIC AGGLOMERATING AGENT

The third essential ingredient of the agglomerated particulate detergent additive is the organic agglomerating agent. The organic agglomerating agent may be employed in the particulate detergent additive in an amount from about 5% to about 75% by weight, preferably from about 10% to about 50% by weight, and most preferably from about 20% to about 40% by weight.

The organic agglomerating agent (often loosely termed a "glue" or "glue mix") may include starches, notably the dextrin starches. Dextrin starches, or dextrins, are starches which are modified by heating in their natural state. Suitable dextrins include those manufactured by the A. E. Staley Manufacturing Company, Decatur, Illinois 62525 under the trade name STADEX and described in the Staley Technical Bulletin TDS No. 116, incorporated herein by reference.

The Stadex dextrins are produced by partially hydrolyzing corn starch, by heating in a dry atmosphere in the presence of acid. There are three main types, white dextrins, canary or yellow dextrins, and British Gums which are heated longer and catalyzed with little or no acid. The standard method of dextrin manufacture was roasting the starch in a horizontal cooker with agitation. However, Stadex dextrins are made by "fluidizing" powdered starch during the heating cycle for greater conversion uniformity of starch to dextrin by ensuring a more even distribution of heat and acids.

Other examples of suitable dextrins and their preparation are contained in *Starch and Its Derivatives* by J. A. Radley, Chapman and Hall Ltd., London (4th Ed. 1968), incorporated herein by reference, notably in the essay by G. V. Caesar on "Dextrins and Dextrinization" at pages 282–289 and the essay on "The Schardinger dextrins" at pages 290–305. Suitable examples of dextrins and their preparation are also contained in *Chemstry and Industry of Starch* by Ralph W. Kerr, Academic Press, Inc., New York (2nd Ed. 1950), incorporated herein by reference, particularly in the essay "Dextrinization" by G. V. Caesar at pages 345–355, and the essay "Manufacture of Dextrins" at pages 357–373.

Dextrin may be added to the agglomerate in a water solution. This dextrin-in-water solution may comprise from about 10% to about 60% by weight, preferably from about 20% to about 50% by weight, and most preferably from about 30% to about 40% by weight of dextrin.

Other exemplary materials useful as agglomerating agents are described below.

(1) For instance, the polyethylene glycols and polypropylene glycols having a molecular weight of from about 950 to about 30,000 may be obtained from the Dow Chemical Company of Midland, Michigan. Such compounds for example, having a melting point within the range of from about 30° to about 100° C. may be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol.

Similarly, the organic agglomerating agent of the present invention can be a copolymer containing ethylene oxide and propylene oxide units. In this instance the starting compounds will either be ethylene glycol or propylene glycol which is polymerized with a mixture of ethylene and propylene oxide. If desired, the condensation product of ethylene oxide and propylene oxide can be modified to provide a precise mixture of the desired number of molecular units of each species in the overall molecule. This can be accomplished by using blocking agents which are later removed thus allowing one end of the molecule to contain either an ethylene oxide or a propylene oxide moiety. It is further possible to separately prepare polyethylene glycols and then to react that product with a polypropylene glycol thus forming a large copolymer having one hydrophobic (polypropoxy) terminus and the other terminus a hydrophilic moiety (polyethoxy).

Such compounds are readily available from commercial sources in a molecular weight range of from about 950 to 4000. Examples of compounds of this type include certain commercially available Pluronic® which are discussed in the booklet "The Wonderful World of PLURONIC Polyols®" (1971) BASF Wyandotte Corporation (herein incorporated by reference).

The preferred organic agglomerating compounds are polyethylene glycols having a molecular weight of from about 950 to about 12,000, preferably from about 3,000 to about 9,000. A particularily useful material is polyethylene glycol having a molecular weight of about 6000. Such compounds have a melt point in the range of from about 35° C. to about 90° C., preferably from about 40° to about 80° C.

The polyethylene, polypropylene and mixed glycols are conveniently referred to by means of the structural formula $$HO-(CH_2-CH_2O)_m-(CH_2-\overset{CH_3}{\overset{|}{C}}HO)_n-(\overset{CH_3}{\overset{|}{C}}H-CH_2O)_o-H$$

wherein m, n, and o are integers satisfying the molecular weight and temperature requirements given above.

(2) The condensation products of one mole of a saturated or unsaturated, straight or branched chain carboxylic acid having from about 10 to about 18 carbon atoms with from about 20 to about 50 moles of ethylene oxide, which liquefy between the temperatures of about 30° C. and about 100° C. and are solid at temperatures below about 30° C. The acid moiety can consist of mixtures of acids in the above delineated carbon atom range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$, and 9% with 35 moles of ethylene oxide is a specific example of a nonionic containing a mixture of different chain length fatty acid moieties. Other specific examples of nonionics of this type are: the condensation products of one mole of palmitic acid with 40 moles of ethylene oxide; the condensation product of one mole of myristic acid with 35 moles of ethylene oxide; the condensation product of one mole of oleic acid with 45 moles of ethylene oxide; and the condensation product of one mole of stearic acid with 30 moles of ethylene oxide.

(3) The condensation products of one mole of a saturated or unsaturated, straight or branched chain alcohol having from about 10 to about 24 carbon atoms with from about 9 to about 50 moles of ethylene oxide, which liquefy between the temperatures of about 30° C. and 100° C. and are solid at temperatures below about 30° C.. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$, and 9% $C_{16}$ with 45 moles of ethylene oxide ($CNAE_{45}$) is a specific and highly preferred example of a nonionic containing a mixture of different chain length alcohol moieties. Other specific examples of nonionics of this type are the condensation products of one mole of tallow alcohol with 20 moles of ethylene oxide; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

(4) Two specific examples of nonionic surface active agents suitable for use in this invention and not specifically classified herein are polyoxyethylene glyceride esters having a hydrophilic-lipophilic balance (HLB) of 18.1 and polyoxyethylene lanolin derivatives having an HLB of 17:0. Both nonionics are manufactured by Atlas Chemical Industries, Inc.; the trade name of the former is G-1300 and the trade name of the latter is G-1795.

(5) Amides which have a melting point between about 30° C. and 100° C. are also suitable for use in this invention. Specific examples are propyl amide, N-methyl amides having an acyl chain length of from about 10 to about 15 carbon atoms, pentyl anilide and anilides having a carbon chain length of from about 7 to about 12 carbon atoms, oleamide, amides of ricinoleic acid, N-isobutyl amides of pelargonic acid, capric acid, undecanoic acid and lauric acid, N-(2-hydroxyethyl) amides having a carbon chain length of from about 6 to about 10 carbon atoms, N-cyclopentyllauramide and N-cyclopentylstearamide.

(6) The condensation products of one mole of alkyl phenol wherein the alkyl chain contains from about 8 to about 18 carbon atoms with from about 25 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; the condensation products of one mole of hexadecyl phenol with 30 moles of ethylene oxide.

(7) Fatty acids containing from about 12 to about 30 carbon atoms which melt between 30° C. and 100° C. Specific examples of these nonionics are lauric acid, myristic acid, palmitic acid, stearic acid, tallow acid or mixtures of tallow acid and coconut acid, arachidic acid, behenic acid and ligoceric acid. Fatty acids are nonionic when utilized as a conglutinating agent. When the finished granules are utilized in alkaline solutions, however, the fatty acids are saponified to soap, an anionic surface active agent. Fatty acids having from 12 to 18 carbon atoms are preferred to use herein.

(8) Fatty alcohols containing from about 16 to about 30 carbon atoms which melt between 30° C. and 100° C. Specific examples of these nonionics are 1-hexadecanol, 1-octadecanol, 1-eicosanol, 3-docosanol, 1-tetracosanol, and 1-octaosanol.

OPTIONAL CLAY INGREDIENT

The particulate detergent additive may optionally contain smectite clay as an ingredient. Clay compounds, namely sodium and calcium montmorillonites, sodium saponites, and sodium hectorites, can be incorporated into the particulate detergent additive compositions. These smectite clays may be admixed with the particulate detergent additive of this invention at levels from about 5% to about 70% by weight, preferably from about 20% to about 60% by weight, and most preferably from about 25% to about 50% by weight of the resulting admixture. The clays used herein are "impalpable", i.e., have a particle size which cannot be perceived tactilely. Impalpable clays have particle sizes below about 50 microns; the clays used herein have a particle size range of from about 5 microns to about 50 microns.

The clay minerals can be described as expandable, three-layer clays, i.e., aluminosilicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers.

The clays employed in the compositions of the instant invention contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation: smectite clay $(Na)^+ + NH_4OH \rightleftarrows$ smectite clay $(NH_4)^+ + NaOH$. Since the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq/100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971).

The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. of kaolinites to about 150 meq/100 g., and greater, for certain smectite clays. Illite clays although having a three layer structure, are of a nonexpanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydroxyl containing Al and Mg atoms.

It has been determined that illite, attapulgite, and kaolinite clays, with their relatively low ion exchange capacities, are not useful in the instant compositions. Indeed, illite and kaolinite clays constitute a major component of clay soils and, as noted above, are removed from fabric surfaces by means of the instant compositions. However, the alkali metal montmorillonites, saponites, and hectorites, and certain alkaline earth metal varieties of these minerals such as calcium montmorillonites have been found to show useful fabric-softening benefits when incorporated in compositions in accordance with the present invention. Specific examples of such fabric-softening smectite clay minerals are: sodium montmorillonite, sodium hectorite, sodium saponite, calcium montmorillonite, and lithium hectorite. Accordingly, smectite clays useful herein can be characterized as montmorillonite, hectorite, and saponite clay minerals having an ion exchange capacity of at least about 50 meq/100 g., and preferably at least 60 meq/100 g.

The above discussion of optional clay additives is intended to only be a brief cursory review of the subject matter contained in U.S. Pat. No. 3,936,537, incorporated herein by reference.

SURFACTANT

The particulate combination of water-soluble, neutral or alkaline salt, quaternary ammonium antistatic compound, and organic dispersion inhibitor may be further incorporated by dry admixing in a detergent composition with a surfactant selected from the group consisting of anionic, nonionic, zwitterionic surfactants, and mixtures thereof. From about 5% to about 85% by weight, preferably from about 5% to about 50% by weight, and most preferably from about 10% to about 25% by weight of the final detergent composition can comprise the organic surfactant selected from the group consisting of anionic, nonionic, ampholytic, and zwitterionic surfactants and mixtures thereof. Examples of organic surfactants of these types are described in U.S. Pat. No. 3,579,454, incorporated herein by reference, from column 11, line 45 through column 13, line 64. An extensive discussion of surfactants is contained in U.S. Pat. No. 3,936,537 from column 11, line 39 through column 13, line 52, already incorporated hereinabove by reference.

OTHER OPTIONAL INGREDIENTS

Other optional ingredients which may be included in the detergent composition include detergency builders enumerated in the Baskerville patent from column 13, line 54 through column 16, line 17, as well as antitarnish and anticorrosion agents, perfume and color additives, and other optional ingredients enumerated in the Baskerville patent, U.S. Pat. No. 3,936,537, from column 19, line 53 through column 21, line 21.

The detergent compositions of the instant invention may contain a detergency builder in an amount from about 5% to about 85% by weight, preferably from about 15% to about 60% by weight, and most preferably from about 20% to about 40% by weight of the entire detergent composition.

METHOD OF PREPARATION

Initially, the mixture of quaternary ammonium compound and organic dispersion inhibitor is prepared before the inclusion of the water-soluble, neutral or alkaline salt.

Quaternary softening and antistat materials are conventionally supplied as a mixture with a solvent material such as a lower alkanol, e.g., isopropanol. This aids dispersion in aqueous media but is disadvantageous to the present invention. Consequently, quaternary materials for use in this invention are preferably low in solvent and ideally are substantially free thereof. It will be appreciated that the greater the water solubility of the quaternary ammonium compound, the larger will be the amount of organic dispersion inhibitor and/or the smaller its water solubility in order to satisfy the essential criteria of the invention. Correspondingly for a particular quaternary ammonium compound the greater the water solubility of an organic dispersion inhibitor, the more will have to be used.

The particulate detergent additive product is made by intimately mixing the quaternary antistat and the organic dispersion inhibitor and then forming this mixture into particulates. This can be accomplished by dry mix addition followed by a mechanical process such as extrusion or milling to form the particulates. However, a preferred technique involves comelting of the two materials prior to the particle formation.

In the preferred embodiments of the present invention, comelting permits the formation, when the mixture is subsequently cooled, of a solid phase which is crystallographically distinct from either of the individual components. This phase is believed to enhance the inhibition of the solubility of the quaternary antistat organic dispersion inhibitor particle, even when the latter has a size in the range of 10μ to 50μ. The formation of the particulates from the comelt can be carried out in a number of ways. The mixture can be sprayed via a single- to two-fluid pressure nozzle to form droplets of the desired size range, i.e. from about 20μ to about 250μ which are then solidified by cooling and subjected to screening to remove material which is either too coarse or too fine. A tower-prilling technique can also be used to obtain the same result, namely a mixture of substantially spherical droplets having a broad spread of particle sizes about a given mean.

Alternatively a prilling process such as that disclosed in German D.O.S. Nos. 2,137,042 and 2,137,043 (both incorporated herein by reference) can be employed. Particulates made in this manner are entirely satisfactory for the purpose of delivering an antistat benefit in accordance with the invention. However, such particulates are less satisfactory from an aesthetic standpoint in that they are visible as a deposit on fabrics which have been removed from the wash liquor but have not been subjected to machine drying. The use of elevated drying temperatures together with the tumbling effect created by the rotary motion of the dryer, serves to soften the particulates and spread them over the fabrics to give the desired antistat benefit and eliminate their aesthetic disadvantage.

Another method of obtaining particulates of the desired size range which are not visible to the naked eye on fabrics removed from the wash solution is as follows.

The comelt of quaternary ammonium compound and dispersion inhibitor is solidified and then comminuted to obtain particles which are irregular and angular rather than uniform and spherical in shape. High energy comminution processes such as hammer, rod, and ball mills and air impact mills can be used but preferably a low energy input process is employed which does not result in an appreciable temperature increase of the material being treated. While the theory of the process is not fully understood, it is believed that a low energy comminution process such as grating through a sieve avoids the surface softening or melting associated with processes involving higher energy inputs and thereby minimizes agglomeration of the comminuted material. Any agglomerates which do form are fragile in nature and disintegrate under the subsequent agitated conditions of the wash into individual particles of the desired size range.

The quaternary ammonium-organic dispersion inhibitor comelt, or prill, is in the particle size range of 20–150 microns. This prevents direct addition to detergent granules because of segregation problems. One of the objectives of agglomerating the prills with a water-soluble, neutral or alkaline salt is to increase the particle size of the particulate antistatic additive to comparable size with the granular detergent composition. Smectite clay is optionally admixed with the agglomerated antistatic additive to provide an additional fabric-softening benefit.

After initial combination of the quaternary ammonium compound and organic dispersion inhibitor into a comelt or prill, the water-soluble neutral or alkaline salt, preferably sodium tripolyphosphate, is mixed with the prills to make the resulting mixture free-flowing as well as to provide more strength to the finished agglomerate.

The mixture of prills and salt is fed into a highly efficient mixer where agglomerating agent (dextrin glue solution) is sprayed onto the mixture. Types of mixers which may be employed include the Schugi mixer (Flexomix 160, 250, 335 or 400), the O'Brien mixer, the Littleford mixer, the Patterson-Kelly mixer, ribbon mixers, and/or virtually any of the conventionally-known pan agglomerators. This results in agglomerates of water-soluble, neutral or alkaline salt and prills of quaternary ammonium compound and organic dispersion inhibitor in the same size range as conventional detergent granules, thus eliminating the problem of segregation (about 150–1190 microns in size). The final agglomerates are discharged from the (Schugi) mixer and optionally admixed with particulate, smectite clay. The resulting admixed composition is aged for approximately one hour, optionally mixed with silica if increased flowability is desired, and admixed with conventional detergent granules.

Certain of the water-soluble, neutral or alkaline salts may absorb moisture during the processing of the agglomerate. In addition, some of the water-soluble neutral or alkaline salts function as detergency builders in wash water. But surprisingly, for some unknown reason, the mixture of prills and water-soluble neutral alkaline salt, when agglomerated, provides increased static control performance relative to agglomerated prills either alone or simply admixed with water-soluble, neutral or alkaline salts.

EXAMPLE I

A laundry wash additive composition was prepared as follows:

| Ingredient | Weight Percent |
|---|---|
| Dimethyl di-hydrogenated tallow ammonium chloride (95% active powder) | 75 |
| Tallow alcohol | 25 |
| | 100 |

The dimethyl di-hydrogenated tallow ammonium chloride (DTDMAC) and tallow alcohol were melted together to form a clear solution at 250° F. This molten solution was atomized at 1600 psi into a chamber with ambient temperature air passing through the chamber. The atomized droplets froze into solid particles in the size range of about 20 microns to about 150 microns. The softening point of the DTDMAC/tallow alcohol mixture was found to be about 165° F. The DTDMAC/tallow alcohol mixture had a solubility of substantially less than 10ppm in 25° C. water. The prills in all the subsequent examples have essentially the same characteristics.

Sodium tripolyphosphate (STP) was then mixed with the DTDMAC/tallow alcohol prills in a 4:7 ratio of tripolyphosphate:prill. The sodium tripolyphosphate was a dry, anhydrous, powder with at least 90% passing through a 100-mesh Tyler sieve. The 7:4 ratio DTDMAC/tallow alcohol prill: sodium tripolyphosphate (STP) mixture is fed into a Schugi mixer (Flexomix 160) where about 5 parts dextrin glue solution (1.67 parts dextrin, 3.33 parts water) is sprayed onto the mixture. This results in agglomerates of prill-STP in the same size range as other detergent granules, about 150–1190 microns.

The 16 parts prill-STP agglomerates are then discharged from the Schugi Flexomix 160 mixer and mixed with about 12 parts of sodium montmorillonite clay of good fabric softening performance and having an ion exchange capacity of about 63 meq/100g (available from Georgia Kaolin Co. USA under the trade name Brock). The resulting mix was aged for approximately one hour and then mixed with 0.4 parts of silica to increase flowability. The total admix comprised 7 parts DTDMAC/tallow alcohol prill, 4 parts STP, 5 parts dextrin glue solution, 12 parts sodium montmorillonite clay, and 0.4 parts silica, resulting in a 28.4 part admix to detergent granules.

The mixture of DTDMAC/tallow alcohol prill and sodium tripolyphosphate (STP), when agglomerated, provides increased static control performance relative to agglomerated DTDMAC/tallow alcohol prills either alone or when merely admixed with other salts such as sodium sulfate, or even sodium tripolyphosphate.

The 0.4 parts silica is an optional additive, and substantially similar results are achieved without its inclusion. A 35% dextrin in water glue solution will work just as effectively as the 33.4% dextrin in water-glue solution employed herein.

Substantially similar results are obtained when sodium tripolyphosphate is replaced with sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, and mixtures of these water-soluble, alkaline salts.

Comparable results are obtained when the quaternary ammonium compound utilized is ditallowdimethyl ammonium methylsulfate, ditallowdimethyl ammonium ethylsulfate, 1-methyl-1-[(tallowamido)ethyl]-2-tallow imidazolinium methylsulfate, or mixtures thereof in place of the ditallowdimethyl ammonium chloride on a part for part basis.

Substantially similar results are obtained when the organic dispersion inhibitor is a mixture of $C_{10}$–$C_{22}$ alkyl sorbitan esters, the major components of which is one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

Other types of clay which when substituted for sodium montmorillonite yield comparable fabric-softening performance include sodium hectorite, sodium saponite, calcium montmorillonite, lithium hectorite, and mixtures thereof.

Other types of mixers which are used in place of the Schugi Flexomix 160 are the Schugi Flexomix 250, 335, and 400, the O'Brien mixer, the Littleford mixer, the Patterson-Kelly mixer, ribbon mixers, and/or virtually any of the conventionally known pan agglomerators.

EXAMPLE II

The particulate detergent additive of Example I is incorporated into a detergent composition as follows:

| Ingredient | Weight Percent | |
|---|---|---|
| Sodium $C_{11.8}$ alkylbenzene sulfonate | 7.70 | |
| Sodium tallow alkyl sulfate | 4.23 | |
| Sodium $C_{14-16}$ alkyl triethoxy sulfate | 4.23 | |
| Sodium tripolyphosphate | 19.25 | |
| Sodium silicate (2.0 ratio) | 11.55 | |
| Sodium sulfate | 19.25 | |
| Water | 3.85 | |
| Miscellaneous (perfume, brightener, etc.) | 1.54 | |
| subtotal weight % | | 71.6% |
| Plus the particulate detergent admix: | | |
| Sodium montmorillonite | 12.0% | |
| Silica | 0.4% | |
| AGGLOMERATE | | |
| Sodium tripolyphosphate | 4.0% | |
| DTDMAC/tallow alcohol prill | 7.0% | |
| Dextrin glue solution | 5.0% | |
| subtotal weight % | | 28.4% |
| TOTAL weight % | | 100.0% |

EXAMPLE III

A ditallow dimethyl ammonium chloride and tallow alcohol prill was prepared according to the procedure in Example I. The proportions of ingredients were 5.0 parts DTDMAC to 1.8 parts tallow alcohol, with 0.2 parts water and miscellaneous ingredients.

The DTDMAC/tallow alcohol prill had a size range of about 20 microns to about 150 microns, a solubility of substantially less than 50ppm in 25° C. water, and a softening point of about 165° F. DTDMAC/tallow alcohol prills may be produced in the size range from about 50 microns to about 100 microns by the same process.

This prill was agglomerated with sodium tripolyphosphate granules in accordance with the procedure in Example I, 7 parts prill to 4 parts sodium tripolyphosphate. The sodium tripolyphosphate was a dry, anhydrous powder with at least 90% passing through a 100-mesh Tyler sieve. About 5 parts of glue mix, which comprised 1.67 parts dextrin and 3.33 parts water, was sprayed onto the mixture at this point, in accordance with the procedure of Example I.

After agglomeration, about 12 parts of sodium montmorillonite clay having an ion exchange capacity of about 63 meq/100 g. (Available from Georgia Kaolin Co. USA under the trade name Brock) was admixed with the agglomerates, resulting in a 28.0 part admix. This 28.0 part admix was further incorporated in a detergent composition of the following:

| Component | % of Finished Product |
|---|---|
| Sodium $C_{12}$ linear alkyl benzene sulfonate | 12.0 parts |
| Sodium fatty alcohol ($C_{14-16}$) polyethylene oxide (polyethoxylate $EO_{1.0}$) sulfate | 6.0 parts |
| Sodium silicate solids (2.0 ratio) | 12.0 parts |
| Sodium tripolyphosphate crutched (total) | 16.7 parts (24.4 parts) |
| Sodium sulfate total (crutched) | 14.3 parts (1.3 parts) |
| Tallow fatty acid | 0.5 parts |
| Coconut alcohol, polyethoxylate ($EO_6$) | 0.25 parts |
| Brightener | 0.294 parts |
| Perfume | 0.15 parts |
| Water | 4.0 parts |
| Miscellaneous (tower gain) | 0.8 parts |
| Base granules | 67.0 parts |
| Color speckles (STP) | 5.0 parts (3.7 parts) |
| | 72.0 parts total |

The 72.0 parts of conventional detergent composition plus the 28.0 parts of admix totalled to 100 parts in all.

Other water-soluble, neutraline or alkaline salts which are substituted for sodium tripolyphosphate include sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, the mixtures of the water-soluble, alkaline salts.

Comparable results are obtained when the quaternary ammonium compound utilized is ditallowdimethyl ammonium methylsulfate, ditallowdimethyl ammonium ethylsulfate, 1-methyl-1-[(tallow amido)ethyl]-2-tallow imidazolinium methyl sulfate, or mixtures thereof in place of the ditallowdimethyl ammonium chloride on a part for part basis. Also, comparable results are achieved with a DTDMAC/tallow alcohol prill in the size range of about 50 microns to about 100 microns.

Substantially similar results are obtained when the organic dispersion inhibitor is a mixture of $C_{10}$–$C_{22}$ alkyl sorbitan esters, the major components of which are one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

Other kinds of organic agglomerating agents yielding substantially equivalent results when substituted for dextrin on a part-for-part basis include polyethylene glycol, polypropylene glycol, the condensation product of one mole carboxylic acid having from about 10 to about 18 carbon atoms with from about 20 to about 50 moles ethylene oxide, the condensation product of one mole alcohol having from about 10 to about 24 carbon atoms with from about 9 to about 50 moles ethylene oxide, polyoxyethylene ($EO_{100}$) glyceride, polyoxyethylene ($EO_{100}$) lanolin derivative, tallow amide, and the condensation product of one mole alkyl phenol having an alkyl chain from about 8 to about 18 carbon atoms with from about 25 to about 50 moles of ethylene oxide, and mixtures thereof.

Other types of clay yielding substantially equivalent fabric softening results when substituted for sodium montmorillonite on a part-for-part basis include sodium hectorite, sodium saponite, calcium montmorillonite, lithium hectorite, and mixtures thereof having ion exchange capacities of greater than 60 meq/100 g.

A 35% by weight dextrin in water glue mix is just as effective as the 33.4% by weight dextrin in water glue mix used hereinabove.

EXAMPLE IV

A ditallow dimethyl ammonium chloride and tallow alcohol prill was prepared according to the procedure in Example I. The proportions of ingredients were 5.0 parts DTDMAC to 1.8 parts tallow alcohol, with 0.2 parts water and miscellaneous ingredients. This prill was agglomerated with sodium tripolyphosphate granules in accordance with the procedure in Example I, 7 parts prill to 4 parts sodium tripolyphosphate. The sodium tripolyphosphate was a dry, anhydrous powder with at least 90% passing through a 100-mesh Tyler sieve. About 5 parts of glue mix, which comprises 1.67 parts dextrin and 3.33 parts water, was sprayed onto the mixture at this point, in accordance with the procedure of Example I.

After agglomeration, about 8 parts of sodium montmorillonite clay having an ion exchange capacity of about 63 meq/100 g. (available from Georgia Kaolin Co. USA under the trade name Brock) was admixed with the agglomerates, resulting in a 24.0 part admix. This 24.0 part admix was further incorporated in a detergent composition of the following:

| Component | % of Finished Product |
|---|---|
| Sodium $C_{12}$ linear alkyl benzene sulfonate | 12.0 parts |
| Sodium fatty alcohol ($C_{14-16}$) polyethylene oxide (polyethoxylate $EO_{1.0}$) sulfate | 6.0 parts |
| Sodium silicate solids (2.0 ratio) | 12.0 parts |
| Sodium tripolyphosphate crutched (total) | 16.7 parts (24.4 parts) |
| Sodium sulfate total (crutched) | 18.3 parts (5.3 parts) |
| Tallow fatty acid | 0.5 parts |
| Coconut alcohol, polyethoxylate ($EO_6$) | 0.25 parts |
| Brightener | 0.294 parts |
| Perfume | 0.15 parts |
| Water | 4.0 parts |
| Miscellaneous (tower gain) | 0.8 parts |
| Base granules | 71.0 parts |
| Color speckles (STP) | 5.0 parts (3.7 parts) |
| | 76.0 parts total |

The 76.0 parts of conventional detergent composition plus the 24.0 parts of agglomerate plus clay admix totalled to 100 parts in all.

Comparable performance is obtained when sodium tripolyphosphate is substituted with sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, and mixtures of the water-soluble, alkaline salts. Comparable results are obtained when the quaternary ammonium compound utilized is ditallowdimethyl ammonium methylsulfate, ditallowdimethyl ammonium ethylsulfate, 1-methyl-1-[(tallow amido)ethyl]-2-tallow imidazolinium methyl sulfate, or mixtures thereof in place of the ditallowdimethyl ammonium chloride on a part for part basis.

Substantially similar results are obtained when the organic dispersion inhibitor is a mixture of $C_{10}$–$C_{22}$ alkyl sorbitan esters, the major components of which are one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

Other types of clay which, when substituted for sodium montmorillonite on a part-for-part basis, yield comparable fabric-softening performance include sodium hectorite, sodium saponite, calcium montmorillonite, lithium hectorite, and mixtures thereof having ion exchange capacities of more than 60 meq/100 g.

A 35% by weight dextrin in water glue mix is employed just as effectively as the 33.4% by weight dextrin in water glue mix used hereinabove.

EXAMPLE V

A ditallow dimethyl ammonium chloride and tallow alcohol prill may be prepared according to the procedure in Example I. The proportions of ingredients are 5.0 parts DTDMAC to 1.8 parts tallow alcohol, with 0.2 parts water and miscellaneous ingredients. This prill is agglomerated with sodium tripolyphosphate granules in accordance with the procedure in Example I, 7 parts prill to 4 parts sodium tripolyphosphate. The sodium tripolyphosphate is a dry, anhydrous powder with at least 90% passing through a 100-mesh Tyler sieve. About 5 parts of glue mix, which comprises 1.67 parts dextrin and 3.33 parts water, is sprayed onto the mixture at this point, in accordance with the procedure of Example I.

After agglomeration, this 16.0 part agglomerate is further incorporated in a detergent composition of the following:

| Component | % of Finished Product |
|---|---|
| Sodium $C_{12}$ linear alkyl benzene sulfonate | 12.0 parts |
| Sodium fatty alcohol ($C_{14-16}$) polyethylene oxide (polyethoxylate $EO_{1.0}$) sulfate | 6.0 parts |
| Sodium silicate solids (2.0 ratio) | 12.0 parts |
| Sodium tripolyphosphate crutched (total) | 16.7 parts (24.4 parts) |
| Sodium sulfate total (crutched) | 26.3 parts (13.3 parts) |
| Tallow fatty acid | 0.5 parts |
| Coconut alcohol, polyethoxylate ($EO_6$) | 0.25 parts |
| Brightener | 0.294 parts |
| Perfume | 0.15 parts |
| Water | 4.0 parts |
| Miscellaneous (tower gain) | 0.8 parts |
| Base granules | 71.0 parts |
| Color speckles (STP) | 5.0 parts (3.7 parts) |
| | 84.0 parts total |

The 84.0 parts of conventional detergent composition plus the 16.0 parts of agglomerate total to 100 parts in all.

Comparable results are obtained when sodium tripolyphosphate is substituted with sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexametaphosphate, potassium heexametaphosphate, sodium sulfate, potassium sulfate, sodium citrate, potassium citrate, and mixtures of the water-soluble, alkaline salts.

Comparable results are obtained when the quaternary ammonium compound utilized is ditallowdimethyl ammonium methylsulfate, ditallowdimethyl ammonium ethylsulfate, 1-methyl-1-[(tallow amido)ethyl]-2-tallow imidazolinium methyl sulfate, or mixtures thereof in place of the ditallowdimethyl ammonium chloride on a part for part basis.

Substantially similar results are obtained when the organic dispersion inhibitor is a mixture of $C_{10}$–$C_{22}$ alkyl sorbitan esters, the major components of which are one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

A 35% by weight dextrin in water glue mix is employed just as effectively as the 33.4% by weight dextrin in water glue mix used hereinabove.

EXAMPLE VI

The particulate detergent admix of Example III may be incorporated into a detergent composition as follows:

| Ingredient | Weight Percent (approximate) | |
|---|---|---|
| Sodium sulfate | 4.0 | |
| Sodium tripolyphosphate | 21.84 | |
| Sodium perborate:$4H_2O$ | 16.46 | |
| Borax | 6.17 | |
| Tallow ethoxylate (tallow alcohol condensed with an average of 22 ethylene oxide groups) | 3.13 | |
| Spray-dried granules (comprising, in weight percent, 10% linear sodium alkylbenzene sulfonate, 20% sodium carbonate, 20% sodium silicate, and 50% sodium sulfate and water) | 19.75 | |
| Enzyme (Alcalase [Novo] and protease [Miles' Laboratories]) | .25 | |
| Brightener, dye, perfume and water | .41 | |
| | | 72.0% |
| Plus the particulate detergent admix: | | |
| Sodium montmorillonite | 12.0 | |
| AGGLOMERATE | | |
| Sodium tripolyphosphate | 4.0 | |
| DTDMAC/tallow alcohol prill | 7.0 | |
| Glue mix | 5.0 | |
| subtotal weight % | | 28.0% |
| TOTAL weight % | | 100.0% |

EXAMPLE VII

An agglomerate was prepared according to the procedures outlined in Example I and admixed with clay in the following proportions:

| Ingredient | | Parts |
|---|---|---|
| Sodium montmorillonite clay (ion exchange capacity of 63 meq/100 g, commercially available as Brock) | | 12.0 |
| AGGLOMERATE | | |
| Sodium tripolyphosphate (anhydrous powder, at least 90% pasing through a 100-mesh Tyler sieve) | | 2.0 |
| DTDMAC/tallow alcohol prill: | | |
| Ditallowdimethyl ammonium chloride | 5.0 | |
| Tallow alcohol | 1.8 | |
| Miscellaneous, water | 0.2 | |
| | 7.0 | 7.0 |
| Glue mix: | | |
| Dextrin | 1.67 | |
| Water | 3.33 | |
| | 5.0 | 5.0 |
| | | 26.0 |

This particulate detergent admix was combined with a detergent composition of the following proportions:

| | |
|---|---|
| Sodium $C_{12}$ linear alkylbenzene sulfonate | 12.0 |
| Sodium fatty alcohol ($C_{14-16}$) polyethylene oxide (polyethoxylate $EO_{1.0}$) sulfate | 6.0 |
| Sodium silicate solids (2.0 ratio) | 12.0 |
| Sodium tripolyphosphate crutched (total) | 18.7 (24.4 parts) |
| Sodium sulfate total (crutched) | 14.3 (1.3 parts) |
| Tallow fatty acid | 0.5 |
| Coconut alcohol, polyethoxylate ($EO_6$) | 0.25 |
| Brightener | 0.294 |
| Perfume | 0.15 |
| Water | 4.0 |
| Miscellaneous (tower gain) | 0.8 |
| Base granules | 69.0 |
| Color speckles (STP) | 5.0 (3.7 parts) |
| | 74.0 TOTAL |

The 74.0 parts of conventional detergent composition plus the 26.0 parts of agglomerate plus clay admix totaled to 100 parts in all.

EXAMPLE VIII

An agglomerate was prepared according to the procedure outlined in Example I and combined with clay in the following proportions:

| | | Parts by Weight |
|---|---|---|
| Sodium montmorillonite clay (ion exchange capacity 63 meq/100 g, commercially available as Brock) | | 12.0 |
| AGGLOMERATE | | |
| Sodium tripolyphosphate (anhydrous powder, at least 90% passing through a 100-mesh Tyler sieve) | | 6.0 |
| DTDMAC/tallow alcohol prill: ditallowdimethyl ammonium chloride | 5.0 | |
| Tallow alcohol | 1.8 | |
| Miscellaneous, water | 0.2 | |
| | 7.0 | 7.0 |
| Glue mix: | | |
| Dextrin | 1.67 | |
| Water | 3.33 | |
| | 5.0 | 5.0 |
| | | 30.0 TOTAL |

This particulate detergent admix was combined with a detergent composition of the following proportions:

| | |
|---|---|
| Sodium $C_{12}$linear alkylbenzene sulfonate | 12.0 |
| Sodium fatty alcohol ($C_{14-16}$) polyethylene oxide (polyethoxylate $EO_{2.25}$) sulfate | 6.0 |

-continued

| | |
|---|---|
| Sodium silicate solids (2.0 ratio) | 12.0 |
| Sodium tripolyphosphate crutched (total) | 14.7 (24.4 parts) |
| Sodium sulfate total (crutched) | 14.3 (1.3 parts) |
| Tallow fatty acid | 0.5 |
| Coconut alcohol polyethoxylate ($EO_6$) | 0.25 |
| Brightener | 0.294 |
| Perfume | 0.15 |
| Water | 4.0 |
| Miscellaneous (tower gain) | 0.8 |
| Base granules | 67.0 |
| Color speckles (STP) | 5.0 (3.7 parts) |
| | 70.0 TOTAL |

The 70.0 parts of conventional detergent composition plus the 30.0 parts of agglomerate plus clay admix totaled to 100 parts in all.

EXAMPLE IX

The particulate detergent agglomerate-clay admixes prepared in Examples III, VII, and VIII were sifted through 10-mesh Tyler sieves and through 14-mesh Tyler sieves, and then combined with the respective detergent compositions and added to wash water solutions. Prior to inclusion in wash water, the compositions of Examples III, VII, and VIII were analyzed for weight percent ditallow dimethyl ammonium chloride (see table below). Fabrics washed therewith and subsequently machine dried were tested for equivalent voltage readings and for static cling after drying. The results were as follows for the following compositions:

| Composition | Tyler Sieve | Weight % DTDMAC in Composition | Average Voltage 1V1/sq. yards | CLING |
|---|---|---|---|---|
| Example VII | 10 mesh | 4.16% | 1.9 volts | 0 |
| | 14 mesh | | 2.3 volts | 0 |
| Example III | 10 mesh | 3.89% | 2.2 volts | 0 |
| | 14 mesh | | 2.5 volts | 0 |
| Example VIII | 10 mesh | 3.67% | 3.1 volts | 0 |
| | 14 mesh | | 3.2 volts | 0 |

The results indicate that the maximum particulate size, as determined by mesh size of the sieve, does not account for differences of antistatic effectiveness between these three compositions. In addition, increasing the amount of STP in the agglomerate over a minimum level of STP does not increase the amount of static control.

EXAMPLE X

Detergent formulations where sodium tripolyphosphate is agglomerated with ditallowdimethyl ammonium chloride and tallow alcohol, were compared with conventional detergent formulations where sodium tripolyphosphate is included only within the base granule and in the speckles. All the sodium tripolyphosphate used is a dry anhydrous powder, at least 90% passing through a 100-mesh Tyler sieve. The agglomerate in the conventional detergent composition was prepared in a pan agglomerator, while the agglomerate including STP was prepared in a Schugi Flexomix 160 mixer.

The composition of the conventional detergent composition, is as follows:

| Base Granule | | % in Finished Product (Parts) | |
|---|---|---|---|
| Sodium $C_{12}$ linear alkylbenzene sulfonate | | 12.0 | |
| Sodium fatty alcohol ($C_{14-16}$) polyethylene oxide (polyethoxylate $EO_{1.0}$) sulfate | | 6.0 | |
| Sodium silicate solids (2.0 ratio) | | 12.0 | |
| Sodium tripolyphosphate crutched (total) | | 20.7 (24.4 parts) | |
| Sodium sulfate total (crutched) | | 16.6 (3.6 parts) | |
| Tallow fatty acid | | 0.5 | |
| Coconut alcohol polyethoxylate ($EO_6$) | | 0.25 | |
| Brightener | | 0.294 | |
| Perfume | | 0.15 | |
| Water | | 4.0 | |
| Miscellaneous (tower gain) | | 0.8 | |
| Base granules | | 73.3 | |
| Speckles (STP) | | 5.0 (3.7 parts) | |
| Subtotal | | | 78.3 |
| Sodium montmorillonite clay (ion exchange capacity of about 63 meq/100 g, available from Georgia Kaolin Co., USA under trade name Brock) | | 12.0 | |
| Agglomerate | | | |
| Prill: | | | |
| Ditallowdimethyl ammonium chloride | 5.0 | | |
| Tallow alcohol | 1.8 | | |
| Miscellaneous + water | 0.2 | | |
| | 7.0 | 7.0 | |
| Glue Mix | | | |
| Dextrin | .9 | | |
| Water | 1.8 | | |
| | 2.7 | 2.7 | |
| | Total additive | | 21.7 |
| | Total | | 100.0 |

Several fabrics were washed with the conventional detergent composition, machine-dried, and checked for average voltage, instances of cling, and relative humidity at designated wash water temperatures. The results of several test runs of the conventional detergent composition in ordinary wash water solution was as follows:

| Sample | Avg. Voltage ϵ1v1/sq. yd. | Instance of Cling | Relative humidity | Temp. |
|---|---|---|---|---|
| 1 | 2.3 volts | 2 | — | 105° F |
| 2 | 2.1 volts | 0 | 40 | 105° F |
| 3 | 2.9 volts | 0 | 41 | 105° F |
| 4 | 4.0 volts | 3 | 42 | 125° F |
| 5 | 3.0 volts | 0 | 42 | 125° F |
| 6 | 2.0 volts | 0 | 47 | 105° F |
| 7 | 4.1 volts | 2 | 47 | 125° F |
| 8 | 1.9 volts | 0 | 48 | 105° F |
| 9 | 2.6 volts | 4 | 45 | 125° F |
| 10 | 1.5 volts | 0 | 51 | 105° F |
| 11 | 2.4 volts* | 3** | | 105° F |
| 12 | 1.8 volts | 3 | 51 | 125° F |

*average of 14 runs, ϵ1v1/sq. yd. = 1.64 - 3.73
**average number of items clinging } 105° F The average of ϵ1v1/sq. yd. for the 20 test runs at 105° F was ϵ1v1/sq. yd. = 2.3 volts.

The average of ϵ1v1/sq. yd. for the five test runs at 125° F, was ϵ1v1/sq. yd. = 3.1 volts.

The composition of the detergent formulation where sodium tripolyphosphate is agglomerated with ditallowdimethyl ammonium chloride and tallow alcohol, is as follows:

| Base Granule | | % in Finished Product (Parts) | |
|---|---|---|---|
| Sodium $C_{12}$ linear alkylbenzene sulfonate | | 12.0 | |
| Sodium fatty alcohol ($C_{14-16}$) polyethylene oxide (polyethoxylate $EO_{1.0}$) sulfate | | 6.0 | |
| Sodium silicate solids (2.0 ratio) | | 12.0 | |
| Sodium tripolyphosphate crutched (total) | | 16.7 (24.4 parts) | |
| Sodium sulfate total (crutched) | | 14.3 (1.3 parts) | |
| Tallow fatty acid | | 0.5 | |
| Coconut alcohol polyethoxylate ($EO_6$) | | 0.25 | |
| Brightener | | 0.294 | |
| Perfume | | 0.15 | |
| Water | | 4.0 | |
| Miscellaneous (tower gain) | | 0.8 | |
| base granules | | 67.0 | |
| Color speckles (STP) | | 5.0 (3.7 parts) | |
| Subtotal | | | 72.0 |
| ADMIX | | | |
| Sodium montmorillonite clay (ion exchange capacity of about 63 meq/100 g, available from Georgia Kaolin Co., USA, under trade name Brock) | | | 12.0 |
| AGGLOMERATE | | | |
| Sodium tripolyphosphate | | | 4.0 |
| Prill: | | | |
| Ditallowdimethyl ammonium chloride | 5.0 | | |
| Tallow alcohol | 1.8 | | |
| Miscellaneous & water | 0.2 | | |
| | 7.0 | | 7.0 |
| Glue mix: | | | |
| Dextrin | 1.67 | | |
| Water | 3.33 | | |
| | 5.0 | | 5.0 |
| | Total additive | | 28.0 |
| | Total | | 100.0 |

Several fabrics were washed with the detergent formulation with sodium tripolyphosphate agglomerated with ditallowdimethyl ammonium chloride and tallow alcohol, machine-dried and checked for average voltage, instances of cling, and relative humidity at designated wash water temperatures. The results of several test runs of the detergent formulation where sodium tripolyphosphate is agglomerated with ditallowdimethyl ammonium chloride and tallow alcohol in ordinary wash water solution is as follows:

| Sample | Av. Voltage ϵlvl/sq. yd. | Instances of Cling | Relative humidity | Temp. |
|---|---|---|---|---|
| 1 | 1.4 volts | 0 | 48 | 100° F |
| 2 | 2.0 volts | 0 | 48 | 125° F |
| 3 | 1.7 volts | 0 | 44 | 100° F |
| 4 | 2.0 volts | 0 | 44 | 125° F |
| 5 | 1.7 volts | 0 | 42 | 100° F |
| 6 | 1.4 volts | 0 | 41 | 125° F |

The average ϵlvl/sq. yd. for the three test runs at 100° F was ϵlvl/sq. yd. = 1.6 volts.
The average ϵlvl/sq. yd. for the three test runs at 125° F was ϵlvl sq. yd. = 1.8 volts.

The average voltage at about 100° F.–105° F. wash water temperature was 0.7 volts less where sodium tripolyphosphate was included in the ditallowdimethyl ammonium chloride (DTDMAC)-tallow alcohol agglomerate. The average voltage at 125° F. wash water temperature was 1.3 volts less where sodium tripolyphosphate (STP) was included in the DTDMAC/tallow alcohol agglomerate. In addition there were no observed instances of static cling between fabrics when STP was included in the DTDMAC/tallow alcohol agglomerate, as opposed to several observed instances of static cling where STP was incorporated in a conventional detergent composition.

The level of sodium tripolyphosphate in these two comparative detergent formulation remained constant, at 24.4 parts/100. Therefore, the improved antistatic, fabric-softening benefits over the conventional detergent composition can only be attributed to agglomerating the sodium tripolyphosphate, a water-soluble, alkaline salt, with the ditallowdimethyl ammonium chloride-tallow alcohol prill.

EXAMPLE XI

The following composition is prepared according to the procedure outlined in Example I, with sodium sulfate substituted for sodium tripolyphosphate in the formation of the agglomerate:

| Ingredient | | Weight % | |
|---|---|---|---|
| $C_{12}$ linear alkyl benzene sulfonate | | 12.0 | |
| Sodium fatty alcohol ($C_{14-16}$) polyethylene oxide (polyethoxylate $EO_{1.0}$) sulfate | | 6.0 | |
| Sodium silicate (2.0 ratio) | | 12.0 | |
| Sodium aluminosilicate | | 20.0 | |
| Sodium sulfate | | 15.3 | |
| Tallow fatty acid | | 0.5 | |
| Brightener | | 0.29 | |
| Sodium sulfosuccinate | | 2.0 | |
| Water | | 6.5 | |
| Coconut alcohol polyethoxylate ($EO_6$) | | 0.25 | |
| Perfume | | 0.15 | |
| Speckles (sodium sulfate) | | 3.0 | |
| | | | 78.0 |
| Sodium montmorillonite clay (ion exchange capacity about 63 meq/100 g.) | | 8.0 | |
| Agglomerate | | | |
| Sodium sulfate | | 4.0 | |
| Prill: | | | |
| Ditallowdimethyl ammonium chloride | 5.0 | | |
| Tallow alcohol | 1.8 | | |
| Miscellaneous + water | 0.2 | | |
| | | 7.0 | |
| Glue mix | | | |
| Dextrin | 1.0 | | |
| Water | 2.0 | | |
| | | 3.0 | |
| | | | 22.0 |
| | | TOTAL WEIGHT | 100.0 |

What is claimed is:

1. A particulate detergent additive for preventing static buildup on textiles and softening fabrics when applied thereto from a detergent wash liquor, said particulate product being an agglomerate of:

(a) from about 5% to about 75% by weight of a water-soluble, neutral or alkaline salt, and (b) from about 5% to about 75% of particles being an intimate mixture of (i) from about 80% to about 20% by weight of the particles of a quaternary ammonium compound of formula $[R_1R_2R_3R_4N]^+Y^-$ wherein at least one but not more than two of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulfate, methylsulfate, ethylsulfate and phosphate ions, and (ii) from about 20% to about 80% by weight of a dispersion inhibitor, being a solid organic material having a solubility in water of 50 ppm maximum at 25° C. and a softening point in the range of 100° F. to 200° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, and (c) from about 5% to about 75% by weight of an organic agglomerating agent, substantially all of the individual particles (b) having a size of about 10μ to about 50μ, and a solubility in water of about 50 ppm maximum at 25° C. and having a softening point of about 100° F. to about 200° F.

2. The particulate detergent additive of claim 1 where substantially all the particles (b) are from about 25μ to about 250μ in size.

3. The particulate detergent additive of claim 2 where substantially all the particles (b) are from about 50μ to about 100μ in size.

4. The particulate detergent additive of claim 1 where the particles (b) have a softening point of about 150° F. to about 175° F.

5. The particulate detergent additive of claim 1 wherein the water-soluble, neutral or alkaline salt is selected from the group consisting of alkali metal carbonate, alkali metal tetraborate, alkali metal ortho phosphate, alkali metal polyphosphate, alkali metal bicarbonate, alkali metal silicate, alkali metal sulfate, alkali metal citrate, and mixtures thereof.

6. The particulate detergent additive of claim 5 where the water-soluble, neutral or alkaline salt is selected from the group consisting of sodium tetraborate, potassium tetraborate, sodium bicarbonate, potassium bicarbonate, sodium carbonate, potassium carbonate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate potassium citrate, and mixtures thereof.

7. The particulate detergent additive of claim 5 which contains from about 5% to about 40% by weight of the water-soluble, neutral or alkaline salt.

8. The particulate detergent additive of claim 7 which contains from about 10% to about 30% by weight of the water-soluble neutral or alkaline salt.

9. The particulate detergent additive of claim 8 which contains from about 10% to about 20% by weight of the water-soluble, neutral or alkaline salt.

10. The particulate detergent additive of claim 7 where the quaternary ammonium compound is selected from ditallow dimethyl ammonium chloride, ditallow dimethyl ammonium methylsulfate, ditallow dimethyl ammonium ethylsulfate, 1-methyl-1-[(tallowamido)ethyl]-2-tallowimidazolinium methylsulfate, and mixtures thereof.

11. The particulate detergent additive of claim 7 wherein the dispersion inhibitor is selected from $C_{10}$–$C_{22}$ acyl sorbitan ester, tallow alcohol, and mixtures thereof.

12. The particulate detergent additive of claim 11 where the dispersion inhibitor is a mixture of $C_{10}$–$C_{22}$ acyl sorbitan esters, the major components of which is one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

13. The particulate detergent additive of claim 11 where the weight ratio of quaternary ammonium compound to dispersion inhibitor is from about 3:2 to about 4:1.

14. The particulate detergent additive of claim 13 where the weight ratio of quaternary compound to dispersion inhibitor is from about 7:3 to about 4:1.

15. The particulate detergent additive of claim 13 which contains from about 10% to about 60% by weight of intimate mixture of quaternary ammonium compound and organic dispersion inhibitor.

16. The particulate detergent additive of claim 15 which contains from about 30% to about 50% by weight of intimate mixture of quaternary ammonium compound and organic dispersion inhibitor.

17. The particulate detergent additive of claim 15 where the organic agglomerating compound is selected from the group consisting of dextrin, a solution of dextrin in water, polyethylene glycol, polypropylene glycol, the condensation product of one mole carboxylic acid having from about 10 to about 18 carbon atoms with from about 20 to about 50 moles ethylene oxide, the condensation product of one mole alcohol having from about 10 to about 24 carbon atoms with from about 9 to about 50 moles ethylene oxide, polyoxyethylene glyceride, polyoxyethylene lanolin derivative, amide, and the condensation product of one mole alkyl phenol having an alkyl chain from about 8 to about 18 carbon atoms with from about 25 to about 50 moles of ethylene oxide, and mixtures thereof.

18. The particulate detergent additive of claim 17 which contains from about 10% to about 50% by weight of organic agglomerating agent.

19. The particulate detergent additive of claim 18 which contains from about 20% to about 40% by weight of organic agglomerating agent.

20. The organic agglomerating agent of claim 18 where the organic agglomerating agent comprises a dextrin-in-water solution from about 10% to about 60% by weight of dextrin.

21. The dextrin-in-water solution of claim 20 comprising from about 20% to about 50% by weight of dextrin.

22. The dextrin-in-water solution of claim 21 comprising from about 30% to about 40% by weight of dextrin.

23. The composition of claim 20 where the particulate detergent additive is additionally admixed with about 5% to about 70% by weight of smectite clay having an ion exchange capacity of at least 50 meq/100 g.

24. The composition of claim 23 where the particulate detergent additive is additionally admixed with about 20% to about 60% by weight of smectite clay.

25. The composition of claim 24 where the particulate detergent additive is additionally admixed with about 25% to about 50% by weight of smectite clay having an ion exchange capacity of at least 60 meq/100 g.

composition of claim 24 where the smectite lected from the group consisting of sodium rillonite, sodium hectorite, sodium saponite, n montmorillonite, and lithium hectorite, and mixtures thereof.

27. The particulate detergent additive of claim 20 where the water-soluble, alkaline salt is sodium tripolyphosphate.

28. The particulate detergent additive of claim 27 where the quaternary ammonium compound is ditallow dimethyl ammonium chloride.

29. The particulate detergent additive of claim 28 where the dispersion inhibitor is tallow alcohol.

30. The composition of claim 29 where the particulate detergent additive is additionally admixed with about 25% to about 50% by weight of sodium montmorillonite clay having an ion exchange capacity of at least 60 meq/100 g.

31. A detergent composition for preventing static buildup on textiles and softening fabrics laundered therewith comprising:

(1) from about 5% to about 85% by weight of surfactant selected from the group consisting of anionic, nonionic, zwitterionic surfactants, and mixtures thereof, (2) from about 5% to about 85% by weight of detergency builder, (3) from about 10% to about 50% by weight of a particulate detergent additive comprising an agglomerate of:

(a) from about 5% to about 75% by weight of a water-soluble, neutral or alkaline salt, and (b) from about 5% to about 75% of particles being an intimate mixture of (i) from about 80% to about 20% by weight of the particles of a quaternary ammonium compound of formula $[R_1R_2R_3R_4N]^+Y^-$ *wherein at least one but not more than two of* $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulphate methylsulfate, ethylsulfate and phosphate ions, and (ii) from about 20% to about 80% by weight of a dispersion inhibitor, being a solid organic material having a solubility in water of 50 ppm maximum at 25° C. and a softening point in the range of 100° F. to 200° F., said material being selected from the group consisting of paraffinic waxes, cyclic and acylic mono- and polyhydric alcohols, substituted and unsubstituted aliphatic carboxylic acids, esters of the foregoing alcohol and acids, $C_3$–$C_4$ alkylene oxide condensates of any of the foregoing materials and mixtures thereof, and (c) from about 5% to about 75% by weight of an organic agglomerating agent, substantially all of the individual particles (b) of the particulate detergent additive having a size of about 10μ to about 500μ, and a solubility in water of about 50 ppm maximum at 25° C. and having a softening point of about 100° F. to about 200° F.

32. The composition of claim 31 where the particular detergent additive comprises from about 5% to about 40% by weight of sodium tripolyphosphate as the water-soluble, neutral or alkaline salt.

33. The composition of claim 32 where the particulate detergent additive comprises from about 10% to about 60% by weight of intimate mixture of ditallow dimethyl ammonium chloride and tallow alcohol in a weight ratio of from about 3:2 to about 4:1 ditallow dimethyl ammonium chloride:tallow alcohol.

34. The composition of claim 33 where the particulate detergent additive comprises from about 10% to about 50% by weight of organic agglomerating agent.

35. The organic agglomerating agent of claim 31 which comprises from about 10% to about 60% by weight of dextrin in a water solution.

36. The composition of claim 35 where the particulate detergent additive is additionally admixed with about 25% to about 50% by weight of sodium montmorillonite clay having an ion exchange capacity of at least 60 meq/100 g.

37. The composition of claim 36 which contains from about 5% to about 50% by weight of surfactant.

38. The composition of claim 37 which contains from about 10% to about 25% by weight of surfactant.

* * * * *

UNITED STATES PATENT AND TRADEMARK OFFICE

CERTIFICATE OF CORRECTION

PATENT NO. : 4,141,841

DATED : February 27, 1979

INVENTOR(S) : Stephen R. McDanald

It is certified that error appears in the above-identified patent and that said Letters Patent are hereby corrected as shown below:

Column 25, line 19, Claim 1, "50μ" should be -- 500μ --.

Signed and Sealed this

*Eighteenth* Day of *December 1979*

[SEAL]

*Attest:*

SIDNEY A. DIAMOND

*Attesting Officer*

*Commissioner of Patents and Trademarks*